US007925198B2

(12) United States Patent
Urano

(10) Patent No.: US 7,925,198 B2
(45) Date of Patent: Apr. 12, 2011

(54) FIXING DEVICE AND IMAGE FORMING APPARATUS

(75) Inventor: Etsuaki Urano, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 48 days.

(21) Appl. No.: 12/399,402

(22) Filed: Mar. 6, 2009

(65) Prior Publication Data

US 2009/0317152 A1 Dec. 24, 2009

(30) Foreign Application Priority Data

Jun. 18, 2008 (JP) ..... 2008-159286

(51) Int. Cl.
*G03G 15/20* (2006.01)

(52) U.S. Cl. ..... 399/333; 399/331

(58) Field of Classification Search ..... 399/333, 399/331, 328; 219/216; 347/156
See application file for complete search history.

(56) References Cited

U.S. PATENT DOCUMENTS

| | | | | |
|---|---|---|---|---|
| 5,426,495 | A | 6/1995 | Sawamura et al. | |
| 5,737,679 | A * | 4/1998 | Uehara et al. | 399/331 X |
| 6,445,902 | B1 * | 9/2002 | Hirst et al. | 399/328 |
| 6,477,350 | B1 | 11/2002 | Nishimura | |
| 7,257,361 | B2 | 8/2007 | Takagi et al. | |
| 2005/0220512 | A1 * | 10/2005 | Tsueda et al. | 399/333 |
| 2006/0291919 | A1 * | 12/2006 | Domoto et al. | 399/328 |
| 2008/0124151 | A1 | 5/2008 | Kagawa | |
| 2009/0317152 | A1 | 12/2009 | Urano | |
| 2010/0054828 | A1 | 3/2010 | Urano | |

FOREIGN PATENT DOCUMENTS

| | | | |
|---|---|---|---|
| JP | 7-028351 | A | 1/1995 |
| JP | 07-064420 | | 3/1995 |
| JP | 8-054798 | A | 2/1996 |
| JP | 09-179427 | | 7/1997 |
| JP | 2001-230065 | | 8/2001 |
| JP | 2002-055552 | A | 2/2002 |
| JP | 2002-082569 | | 3/2002 |
| JP | 2002-328559 | | 11/2002 |
| JP | 2002-328559 | A * | 11/2002 |
| JP | 2003-131504 | | 5/2003 |
| JP | 2003-131504 | A * | 5/2003 |
| JP | 2004-077683 | A | 3/2004 |
| JP | 2005-037859 | | 2/2005 |
| JP | 2005-049812 | A | 2/2005 |
| JP | 2005-326671 | A | 11/2005 |
| JP | 2007-079238 | | 3/2007 |

(Continued)

OTHER PUBLICATIONS

An Office Action issued in corresponding Japanese Patent Application No. 2008-159286, mailed Jun. 29, 2010, and English translation thereof.

(Continued)

*Primary Examiner* — Sophia S Chen
(74) *Attorney, Agent, or Firm* — Buchanan Ingersoll & Rooney PC

(57) ABSTRACT

A fixing device has a fixing roller, a pressure roller, an electromagnetic-induction heating section, and a heat pipe. The pressure roller has a metal layer, so that heat transferred directly from the fixing roller to the pressure roller is thermally transported by the metal layer of the pressure roller, whereby temperature of the pressure roller in its axial direction can be equalized.

16 Claims, 6 Drawing Sheets

FOREIGN PATENT DOCUMENTS

| | | |
|---|---|---|
| JP | 2007-108213 | 4/2007 |
| JP | 2008-102403 | 5/2008 |
| WO | WO 00/05629 | 2/2000 |

OTHER PUBLICATIONS

Office Action (Preliminary Notice of Rejection) dated Sep. 14, 2010, issued in corresponding Japanese Patent Application No. 2008-159286, and an English translation thereof.

Office Action (Preliminary Notice of Rejection) dated Jun. 15, 2010, issued in the corresponding Japanese Patent Application No. 2008-223149, and an English Translation thereof.

Office Action (Preliminary Notice of Rejection) dated Jun. 29, 2010, issued in the corresponding Japanese Patent Application No. 2008-159286, and an English Translation thereof.

Office Action (Preliminary Notice of Rejection) dated Jul. 6, 2010, issued in the corresponding Japanese Patent Application No. 2008-239538, and an English Translation thereof.

* cited by examiner

Fig.7

| | PRESSURE ROLLER COMPOSITION | | | LOW THERMAL-CONDUCTION ELASTIC LAYER 22 | | HEAT PIPE | | EVALUATION 1 | EVALUATION 2 | EVALUATION 3 | EVALUATION 4 |
|---|---|---|---|---|---|---|---|---|---|---|---|
| | MATERIAL OF METAL LAYER 23 | MATERIAL OF HIGH THERMAL-CONDUCTION ELASTIC LAYER 25 | MATERIAL OF MOLD RELEASING LAYER 24 | THERMAL CONDUCTIVITY (W/m·°C) | THICKNESS (mm) | MATERIAL | THERMAL CONDUCTIVITY (W/m·°C) | HEAT UNIFORMITY OF PRESSURE ROLLER | DURABILITY OF PRESSURE ROLLER | DURABILITY OF HEAT PIPE | IMAGE QUALITY OF SHEET |
| EXAMPLE 1 | Ni | ——— | PFA | 0.16 | 4 | Fe | 43 | ○ | △ | ○ | △ |
| EXAMPLE 2 | Ni | ——— | PFA | 0.16 | 4 | Al | 238.8 | ◎ | △ | △ | △ |
| EXAMPLE 3 | SUS | ——— | PFA | 0.16 | 4 | SUS | 14.2 | ○ | △ | ○ | △ |
| EXAMPLE 4 | SUS | SILICONE RUBBER | PFA | 0.16 | 4 | SUS | 14.2 | ○ | ○ | ◎ | ○ |
| EXAMPLE 5 | Ni | SILICONE RUBBER | PFA | 0.16 | 4 | Fe | 43 | ○ | ◎ | ◎ | ◎ |
| EXAMPLE 6 | Ni | SILICONE RUBBER | PFA | 0.16 | 4 | Al | 238.8 | ◎ | ○ | △ | △ |
| EXAMPLE 7 | Ni | SILICONE RUBBER | PFA | 0.16 | 3 | Fe | 43 | ○ | ○ | ○ | ○ |
| EXAMPLE 8 | Ni | SILICONE RUBBER | PFA | 0.3 | 4 | Fe | 43 | ○ | ○ | ○ | ○ |
| EXAMPLE 9 | Ni | SILICONE RUBBER | PFA | 0.7 | 4 | Fe | 43 | △ | △ | ○ | △ |
| COMPARATIVE EXAMPLE 1 | —— | SILICONE RUBBER | PFA | 0.16 | 4 | Fe | 43 | × | —— | ○ | × |

Fig.8A

| | | METAL LAYER OF PRESSURE ROLLER | |
|---|---|---|---|
| | | PROVIDED | UNPROVIDED |
| HEAT PIPE | PROVIDED | 234.2 ℃ | 249.5 ℃ |
| | UNPROVIDED | 247.3 ℃ | 264.8 ℃ |

Fig.8B

| | | METAL LAYER OF PRESSURE ROLLER | |
|---|---|---|---|
| | | PROVIDED | UNPROVIDED |
| HEAT PIPE | PROVIDED | 157.3 ℃ | 189.4 ℃ |
| | UNPROVIDED | 188.2 ℃ | 231.5 ℃ |

FIXING DEVICE AND IMAGE FORMING APPARATUS

CROSS-REFERENCE TO RELATED APPLICATION

This application is based on application No. 2008-159286 filed in Japan, the entire content of which is hereby incorporated by reference.

TECHNICAL FIELD

The present invention relates to a fixing device for use in image forming apparatuses such as copiers, printers and facsimile machines, and also relates to an image forming apparatus having such a fixing device.

BACKGROUND ART

Conventionally, there is a fixing device including a fixing roller, a pressure roller and a heater (see JP 8-54798 A). The fixing roller is heated by the heater. The fixing roller and the pressure roller heat and pressure a recording sheet to fix toner on the sheet. The pressure roller has a core metal, a sponge layer, an elastic layer and a PFA (tetrafluoroethylene perfluoroalkoxy vinyl ether copolymer) tube in this order from radially inside to outside.

However, in this conventional fixing device, since the pressure roller has a core metal, a sponge layer, an elastic layer and a PFA tube in this order from inside to outside, it is difficult for the pressure roller to transport heat which has been transferred directly from the fixing roller to the pressure roller. As a result, it has been the case that temperature of the pressure roller in its axial direction cannot be equalized.

As a consequence, temperature of non-pass areas in continued feeding of small-size recording sheets is increased, causing larger temperature differences between the pass area and the non-pass areas. This involves a need for lowering the heating temperature of the heater to lower the temperature of the non-pass areas, posing a problem of degradation in image quality (fixability) of small-size recording sheets. Furthermore, because of such temperature increases in the non-pass areas, there has been a problem of thermal deterioration of the fixing roller and the pressure roller.

SUMMARY OF INVENTION

Accordingly, an object of the present invention is to provide a fixing device and an image forming apparatus which are capable of suppressing temperature increases in the non-pass areas in continued feeding of a small-size recording sheet to thereby reduce temperature differences between sheet-pass area and non-pass areas, thus preventing degradation in image quality (fixability) of small-size recording sheets and moreover preventing thermal deterioration of the fixing roller and the pressure roller.

In order to achieve the above object, a fixing device according to an aspect of the present invention includes:

a fixing-side rotating member and a pressing-side rotating member which are in contact with each other to fix toner on a recording material while conveying the recording material; and a heating section for heating the fixing-side rotating member, wherein the pressing-side rotating member has at least a core metal and a metal layer provided radially outside the core metal.

According to the fixing device of this invention, since the pressing-side rotating member has the metal layer, heat transferred directly from the fixing-side rotating member to the pressing-side rotating member is thermally transported by the metal layer of the pressing-side rotating member, so that temperature of the pressing-side rotating member in its axial direction can be equalized.

Therefore, temperature increases in the non-pass areas in continued feeding of small-size sheets of the recording material can be suppressed, so that temperature differences between the sheet-pass area and the non-pass areas can be reduced. Thus, there is no need for lowering the heating temperature of the heating section to lower the temperature of the non-pass areas, so that degradation in image quality (fixability) of the small-size recording material is prevented. Also, since temperature increases in the non-pass areas can be suppressed, thermal deterioration of the fixing-side rotating member and the pressing-side rotating member can be prevented.

The fixing device may further include a heat equalizing member which is in contact with the pressing-side rotating member. In this case, the temperature of the pressing-side rotating member in its axial direction can be more equalized.

An image forming apparatus according to another aspect of the invention includes the fixing device as described above.

According to the image forming apparatus of this invention, since the fixing device is included therein, product quality and apparatus durability can be improved.

BRIEF DESCRIPTION OF DRAWINGS

The present invention will become more fully understood from the detailed description given hereinbelow and the accompanying drawings which are given by way of illustration only, and thus are not intended to limit the present invention, and wherein:

FIG. 7 is a table showing evaluations of invention examples and a comparative example;

FIG. 8A is a table showing relationships among presence or absence of a metal layer of the pressure roller, presence or absence of a heat pipe, and temperature of a non-pass area of the fixing roller; and FIG. 8B is a table showing relationships among presence or absence of a metal layer of the pressure roller, presence or absence of a heat pipe, and temperature of a non-pass area of the pressure roller.

DESCRIPTION OF EMBODIMENTS

Hereinbelow, the present invention will be described in detail by way of embodiments thereof illustrated in the accompanying drawings.

First Embodiment

Figure 1:
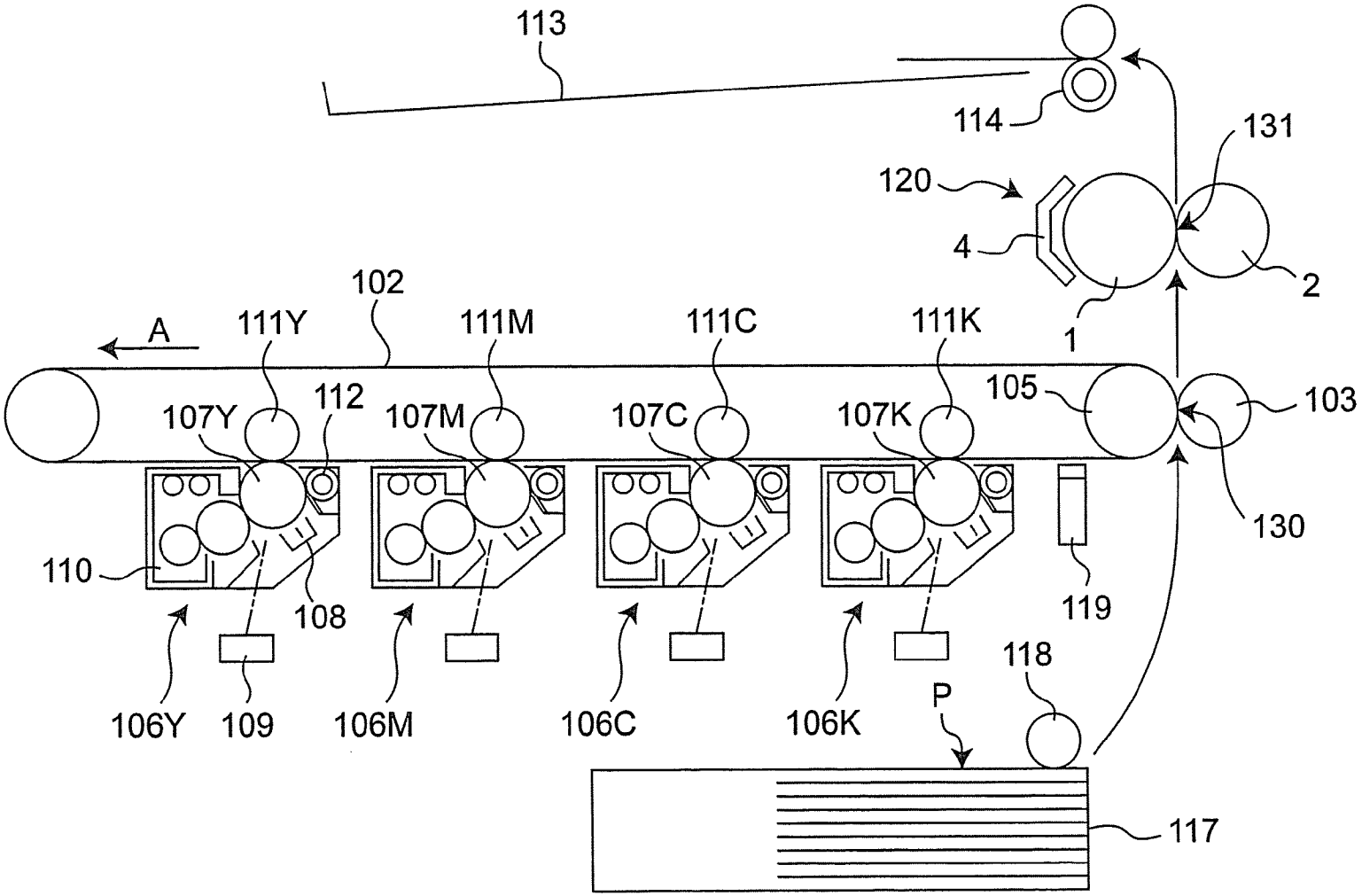
FIG. 1 is a simplified structural view showing an embodiment of the image forming apparatus of the invention.

FIG. 1 shows a simplified structural view of an image forming apparatus of the invention. The image forming apparatus, shown as a color printer, has an intermediate transfer belt 102 as a belt member at a generally center of the inside of the apparatus. Under a lower horizontal portion of the intermediate transfer belt 102, four image forming units 106Y, 106M, 106C, 106K corresponding to yellow (Y), magenta (M), cyan (C) and black (K) colors, respectively, are placed in array along the intermediate transfer belt 102. The image forming units 106Y, 106M, 106C, 106K have photoconductor drums 107Y, 107M, 107C, 107K, respectively.

A charger 108, a print head unit 109, a developer unit 110, a primary transfer roller 111Y, 111M, 111C, 111K, and a cleaner 112 are placed around each of the photoconductor drums 107Y, 107M, 107C, 107K in this order along the rotational direction of the drums. The primary transfer rollers 111Y, 111M, 111C, 111K confront the photoconductor drums 107Y, 107M, 107C, 107K, respectively, with the intermediate transfer belt 102 interposed therebetween.

At a portion of the intermediate transfer belt 102 supported by a driving roller 105, a secondary transfer roller 103 is set in press contact therewith, where a nip portion between the secondary transfer roller 103 and the intermediate transfer belt 102 serves as a secondary transfer area 130.

In a conveyance path on a downstream side of the secondary transfer area 130 is placed a fixing device 120 which has a fixing roller 1, a pressure roller 2 and an electromagnetic-induction heating section 4. A pressure contact portion between the fixing roller 1 and the pressure roller 2 serves as a fixing nip area 131.

A sheet feed cassette 117 is removably set in lower portion of the image forming apparatus. Paper sheets P loaded and accommodated in the sheet feed cassette 117 are fed out to the conveyance path one by one, starting with a topmost one, by rotation of a sheet feed roller 118.

Between the image forming unit 106K on the most downstream side of the intermediate transfer belt 102 and the secondary transfer area 130 is an AIDC (Auto Image Density Control) sensor 119 which serves also as a registration sensor.

Next, operation of the image forming apparatus having the above construction will be described below.

When an image signal is inputted from an external device (e.g., personal computer) to an image signal processing section (not shown) of the image forming apparatus, the image signal processing section converts the image signal in color to form digital image signals of yellow (Y), magenta (M), cyan (C) and black (K), and makes the print head units 109 of the image forming units 106Y, 106M, 106C, 106K, respectively, emit light for exposure based on the inputted digital signals.

As a result, electrostatic latent images formed on the photoconductor drums 107Y, 107M, 107C, 107K are developed by the developer units 110, respectively, resulting in toner images of the individual colors.

Then, by operation of the primary transfer rollers 111Y, 111M, 111C, 111K, the toner images of the individual colors are superimposed sequentially, i.e. primarily transferred, on the intermediate transfer belt 102 that are moving in a direction of arrow A.

The toner images formed on the intermediate transfer belt 102 in this way go on and reach the secondary transfer area 130 along with the movement of the intermediate transfer belt 102. At this secondary transfer area 130, the superimposed toner images of the individual colors are secondarily transferred collectively onto a sheet P by operation of the secondary transfer roller 103.

Thereafter, the toner image secondarily transferred on the sheet P reaches the fixing nip area 131. At this fixing nip area 131, the toner image is fixed to the sheet P by operations of the fixing roller 1, which is induced to heat generation by the electromagnetic-induction heating section 4, and the pressure roller 2.

Then, the sheet P, on which the toner image has been fixed, is discharged to a sheet discharge tray 113 via a sheet discharge roller 114.

Figure 2:
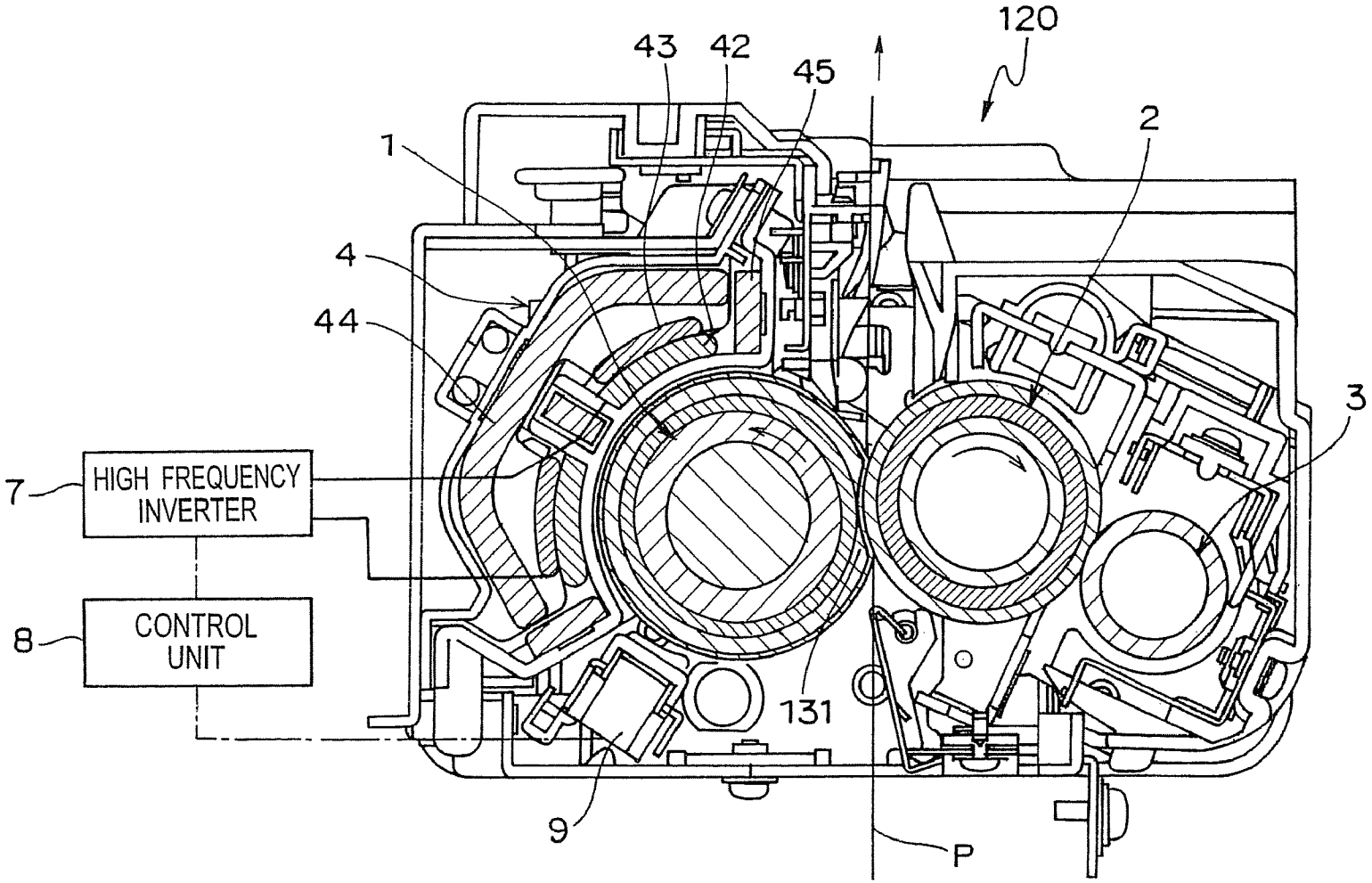
FIG. 2 is a simplified structural view showing an embodiment of the fixing device of the invention.

As shown in FIG. 2, the fixing device 120 has the fixing roller 1 as a fixing-side rotating member, the pressure roller 2 as a pressing-side rotating member, the electromagnetic-induction heating section 4 as a heating section, and a heat pipe 3 as a heat equalizing member.

The fixing roller 1 and the pressure roller 2 are in contact with each other so as to fix the toner to the sheet P while conveying the sheet P as a recording material. The fixing roller 1 is heated by the electromagnetic-induction heating section 4.

The heat pipe 3, being in contact with the pressure roller 2, aids heat transfer on surfaces of the fixing roller 1 and the pressure roller 2 to equalize the surface temperature of the fixing roller 1 and the pressure roller 2.

The fixing roller 1, the pressure roller 2 and the heat pipe 3 are arrayed parallel to one another while both end portions of those members are rotatably supported by unshown bearing members, respectively.

The pressure roller 2 is biased toward the fixing roller 1 by an unshown pressure mechanism, such as a spring, to form the fixing nip area 131. Further, the heat pipe 3 is also in pressure contact with the pressure roller 2.

The pressure roller 2 is driven into rotation in a clockwise direction indicated by an arrow at a specified circumferential speed by an unshown drive mechanism. The fixing roller 1 is rotated subordinately to the rotation of the pressure roller 2 by pressure-contact frictional force with the pressure roller 2 at the fixing nip area 131. Further, the heat pipe 3 is also rotated subordinately by the pressure-contact frictional force of the pressure roller 2.

A surface temperature of the fixing roller 1 is detected by a temperature sensor 9, and a signal of the temperature sensor 9 is inputted to a control unit 8. The temperature sensor 9 is a noncontact type infrared sensor as an example.

The control unit 8 controls heating and temperature adjustment of the fixing roller 1 based on a signal from the temperature sensor 9. That is, the control unit 8 controls a high frequency inverter 7 based on the signal from the temperature sensor 9 so as to increase or decrease electric power supply from the high frequency inverter 7 to the electromagnetic-induction heating section 4, thus exerting automatic control so that the surface temperature of the fixing roller 1 keeps a constant temperature.

The electromagnetic-induction heating section 4 has an exciting coil 42, a degaussing coil 43 and cores 44, 45. The exciting coil 42 is so structured that a conductor wire is curvedly laid on the fixing roller 1 so as to extend along its longitudinal direction (axial direction). The exciting coil 42, which is connected to the high frequency inverter 7, is supplied with a radio-frequency power of 10 to 100 (kHz) and 100 to 2000 (W), with use of a litz wire composed of several tens to hundreds of bundled thin wires covered with heat-resistant resin.

The degaussing coil 43 is curvedly laid on the exciting coil 42 so as to extend along its longitudinal direction. Given that sheet conveyance is done by referencing a longitudinal center of the fixing roller 1, the degaussing coils 43 are placed at longitudinal both end portions of the fixing roller 1.

A magnetic flux induced by the exciting coil 42 passes through the inside of the main core 44 and the tail cores 45, penetrates through an electromagnetic-induction heat generating layer of the fixing roller 1, and induces an eddy current in the electromagnetic-induction heat generating layer, thus generating Joule heat.

The exciting coil 42 and the degaussing coils 43 are connected to the high frequency inverter 7 having a changeover switch. For pass of a large-size sheet, the exciting coil 42 alone is operated while the degaussing coils 43 do not exert the function as coils.

Next, fixing operation will be described. As the pressure roller 2 is driven into rotation, the fixing roller 1 also is subordinately driven, and the fixing roller 1 is heated by the electromagnetic-induction heating section 4. In a state that the surface temperature has come to a constant temperature through automatic control, the sheet P with an unfixed toner image formed and carried thereon is introduced to the fixing nip area 131 between the fixing roller 1 and the pressure roller 2. In this case, an image carrying surface of the sheet P for the unfixed toner image confronts the fixing roller 1.

The sheet P introduced to the fixing nip area 131 between the fixing roller 1 and the pressure roller 2, while nipped and conveyed, is heated by the fixing roller 1 at the fixing nip area 131, so that the unfixed toner image is fused and fixed to the sheet P. Then, the sheet P is discharged.

Figure 3:
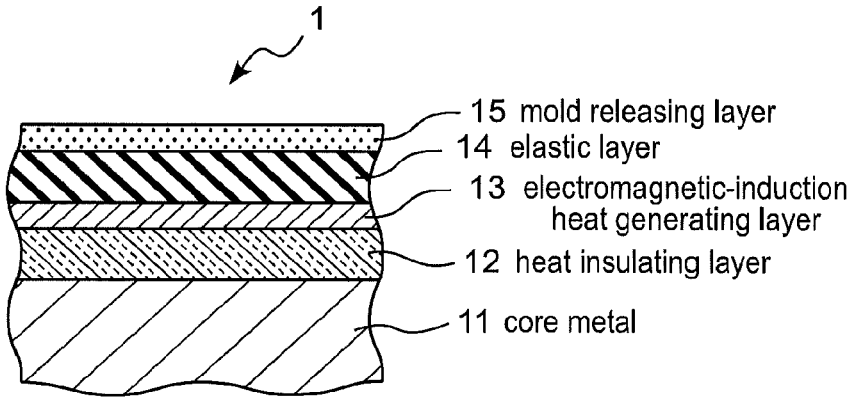
FIG. 3 is an enlarged sectional view of a part of a fixing roller.

As shown in FIG. 3, the fixing roller 1 has a core metal 11, a heat insulating layer 12, an electromagnetic-induction heat generating layer 13, an elastic layer 14 and a mold releasing layer 15 in this order from radially inside to outside.

The core metal 11 is formed of a nonmagnetic stainless steel material. The heat insulating layer 12 is formed of silicone sponge rubber. The electromagnetic-induction heat generating layer 13 is formed of a 35 to 60 μm thick Ni electrocast sleeve. The elastic layer 14 is formed of a 150 to 300 μm thick silicone rubber having a thermal conductivity of 0.5 W/m·° C. or more. The mold releasing layer 15 consists of a 30 to 50 μm thick PFA resin tube.

Figure 4:
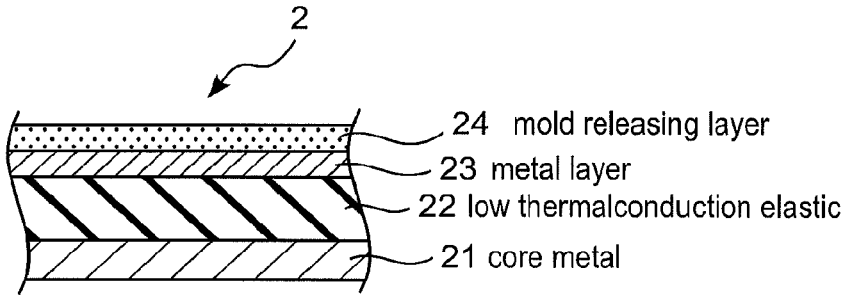
FIG. 4 is an enlarged sectional view of a part of a pressure roller.

As shown in FIG. 4, the pressure roller 2 has a core metal 21, a low thermal-conduction elastic layer 22, a metal layer 23, and a mold releasing layer 24 in this order from radially inside to outside.

The metal layer 23 is formed of a Ni electrocast material, SUS, Fe-based alloy, Al-based alloy, or Cu alloy. The metal layer 23 has a thickness of 35 to 60 μm. Ni has a thermal conductivity of 90.7 W/m·° C. SUS has a thermal conductivity of 14.2 W/m·° C.

The mold releasing layer 24 is formed of PFA powdered resin, PFA dispersion paint, PFA/PTFE mixed dispersion paint, or PFA tube. The mold releasing layer 24 has a thickness of 20 to 50 μm. The mold releasing layer 24 prevents deposition of toner smudges on the pressure roller 2, improving the image quality of the sheet P.

Selecting a material of the metal layer 23 and a material of the mold releasing layer 24 from among those described above allows adhesion of the mold releasing layer 24 to the metal layer 23 to be improved.

The elastic layer 22 is formed of silicone rubber or silicone sponge having a thermal conductivity of 0.3 W/m·° C. or less. The elastic layer 22 is 1 mm or more thick. The elastic layer 22 prevents leakage of heat from the metal layer 23 to the core metal 21.

The metal layer 23 and the elastic layer 22 are not bonded to each other. Therefore, even if the metal layer 23 and the elastic layer 22 are different in coefficient of thermal expansion from each other, the metal layer 23 and the elastic layer 22 are not restrained by each other, thus being prevented from damage.

Figure 5:
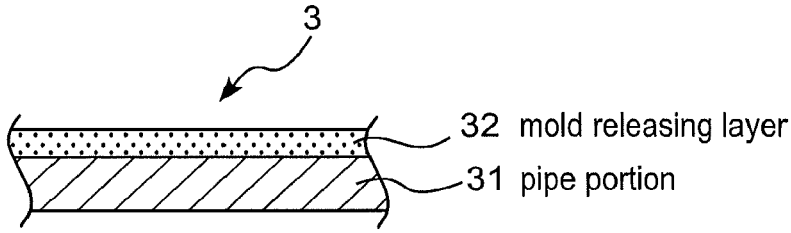
FIG. 5 is an enlarged sectional view of a part of a heat pipe.

As shown in FIG. 5, the heat pipe 3 has a pipe portion 31 and a mold releasing layer 32 outside the pipe portion 31.

The pipe portion 31 is formed of a Fe alloy, SUS or Al alloy. The pipe portion 31 has a thickness of 0.5 mm, an outside diameter of 21 mm and a length of 340 mm.

The mold releasing layer 32 is formed of PFA powdered resin, PFA dispersion paint, PFA/PTFE mixed dispersion paint, or a PFA tube. The mold releasing layer 32 has a thickness of 20 to 50 μm. The mold releasing layer 32 prevents deposition of toner smudges on the heat pipe 3, improving the image quality of the sheet P.

The pipe portion 31 is filled with water as an operating fluid. By gasification and condensation of this operating fluid, heat transfer is conducted so that the temperature of the pressure roller 2 in its axial direction is equalized.

The quantity of water occupies 20% of the capacity of the pipe portion 31. Use of water as an operating fluid facilitates the machining of the heat pipe 3. It is noted here that a solvent, if used as the operating fluid, would make it hard to machine the heat pipe 3.

According to the fixing device constructed as described above, since the pressure roller 2 has the metal layer 23, heat transferred directly from the fixing roller 1 to the pressure roller 2 can be thermally transported by the metal layer 23 of the pressure roller 2, so that the temperature of the pressure roller 2 in its axial direction can be equalized.

Accordingly, temperature increases in the non-pass areas in continued feeding of small-size sheets P are suppressed, so that temperature differences between sheet-pass area and non-pass areas can be reduced. Thus, there is no need for lowering the heating temperature of the heating section to lower the temperature of the non-pass areas, so that degradation in image quality (fixability) of small-size sheets P can be prevented. Also, since temperature increases in the non-pass areas are suppressed, thermal deterioration of the fixing roller 1 and the pressure roller 2 is prevented.

Also, according to the image forming apparatus construction as described above, since the above fixing device is included therein, product quality and apparatus durability can be improved.

Second Embodiment

Figure 6:
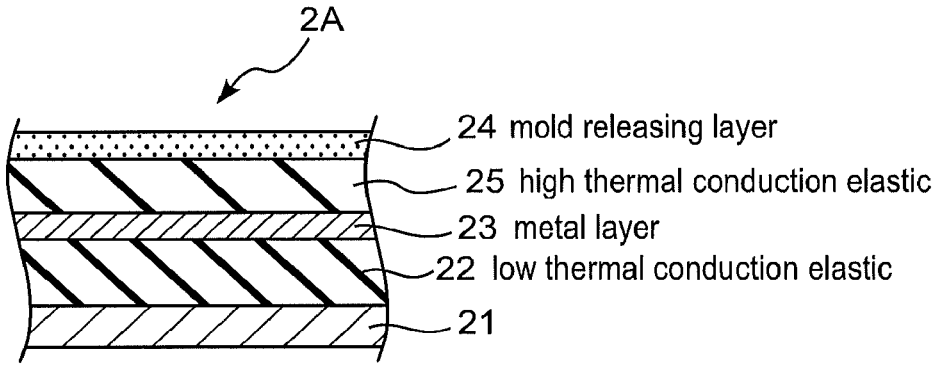
FIG. 6 is an enlarged sectional view of a part of another pressure roller.

FIG. 6 shows a second embodiment of the fixing device of the invention. This second embodiment differs from the first embodiment in terms of the construction of the pressure roller.

As shown in FIG. 6, a pressure roller 2A, as compared with the pressure roller 2 of FIG. 4, has a high thermal-conduction elastic layer 25 between the metal layer 23 and the mold releasing layer 24. It is noted here that like reference signs denote like component members as in the first embodiment, and so their description is omitted.

The high thermal-conduction elastic layer 25 is larger in thermal conductivity than the low thermal-conduction elastic layer 22. The high thermal-conduction elastic layer 25 is formed of silicone rubber having a thermal conductivity of 0.5 W/m·° C. The high thermal-conduction elastic layer 25 is 150 to 300 μm thick. The high thermal-conduction elastic layer 25 functions to more equalize the temperature of the pressure roller 2A in its axial direction.

Next, FIG. 7 shows evaluations of invention examples and a comparative example.

As shown in FIG. 7, Examples 1 to 3 show evaluations with use of the pressure roller 2 of the first embodiment (FIG. 4). Examples 1 to 3 were evaluated as acceptable as shown in evaluations 1 to 4. In the evaluations, symbols '◎' denotes excellent, '○' denotes good, 'Δ' denotes fair, and 'x' denotes failure.

Examples 4 to 9 show evaluations with use of the pressure roller 2A of the second embodiment (FIG. 6). Examples 4 to 9 were evaluated as acceptable as shown in Evaluations 1 to 4. In particular, Example 5 is the best mode.

Comparative Example 1 shows an evaluation with use of a pressure roller having no metal layer. Comparative Example 1 was evaluated as problematic in Evaluations 1 and 4. That is, because of no metal layer included in the pressure roller, the temperature of the pressure roller in its axial direction was not able to be equalized, and the image quality of sheets was also problematic.

Next, FIGS. 8A and 8B show relationships among presence or absence of a metal layer of the pressure roller, presence or absence of a heat pipe, and temperature of a non-pass area.

FIG. 8A shows temperatures of a non-pass area (end portion) of the fixing roller, making it understood that temperature increase in the non-pass area is reduced with the metal layer included in the pressure roller. In this case, the temperature of the sheet-pass area of the fixing roller is 170° C.

FIG. 8B shows temperatures of the non-pass area (end portion) of the pressure roller, making it understood that temperature increase in the non-pass area is reduced with the metal layer included in the pressure roller. In this case, the temperature of the sheet-pass area of the pressure roller is 90° C.

It is to be noted here that the present invention is not limited to the above-described embodiments. For example, the pressing-side rotating member (pressure roller 2) needs only to have at least a core metal and a metal layer provided radially outside the core metal. Also, as the heat equalizing member, a metallic cylindrical member may also be used instead of the heat pipe 3, and the thermal conductivity of the cylindrical member may be 14.0 W/m·° C. or more as an example. Further, as the heating section, a heater may be employed instead of the electromagnetic-induction heating section. The fixing-side rotating member and the pressing-side rotating member may be belt shaped as well as roller shaped.

As is apparent from the foregoing description, a fixing device according to an aspect of the present invention includes:

a fixing-side rotating member and a pressing-side rotating member which are in contact with each other to fix toner on a recording material while conveying the recording material; and a heating section for heating the fixing-side rotating member, wherein the pressing-side rotating member has at least a core metal and a metal layer provided radially outside the core metal.

Also, in an embodiment, the fixing device further includes a heat equalizing member which is in contact with the pressing-side rotating member. Therefore, the temperature of the pressing-side rotating member in its axial direction can be more equalized.

In an embodiment, the heat equalizing member is a heat pipe whose operating fluid is water. In this case, machining of the heat equalizing member is facilitated.

In an embodiment, the heat equalizing member has a mold releasing layer on its outermost side. Thus, deposition of toner smudges onto the heat equalizing member is prevented, so that image quality of the recording material can be improved.

In an embodiment, the pressing-side rotating member has a mold releasing layer radially outside the metal layer. Therefore, deposition of toner smudges onto the pressing-side rotating member is prevented, and image quality of the recording material can be improved.

In one embodiment, the metal layer is formed of a Ni electrocast material, SUS, Fe-based alloy, Al-based alloy, or Cu alloy, and the mold releasing layer is formed of PFA powdered resin, PFA dispersion paint, PFA/PTFE mixed dispersion paint, and/or PFA tube. Therefore, adhesion of the mold releasing layer to the metal layer is improved.

In one embodiment, the pressing-side rotating member has an elastic layer between the core metal and the metal layer. Thus, leakage of heat from the metal layer to the core metal is prevented by the elastic layer.

In one embodiment, the metal layer and the elastic layer are not bonded to each other. Therefore, the metal layer and the elastic layer, even if different in coefficient of thermal expansion from each other, are not restrained by each other, thus being prevented from damage.

In one embodiment, the pressing-side rotating member has an elastic layer between the metal layer and the mold releasing layer. In this case, the temperature of the pressing-side rotating member in its axial direction can be more equalized.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

REFERENCE SIGNS LIST

| | |
|---|---|
| 1: | fixing roller (fixing-side rotating member |
| 11: | core metal |
| 12: | heat insulating layer |
| 13: | electromagnetic-induction heat generating layer |
| 14: | elastic layer |
| 15: | mold releasing layer |
| 2, 2A: | pressure roller (pressing-side rotating member) |
| 21: | core metal |
| 22: | low thermal-conduction elastic layer |
| 23: | metal layer |
| 24: | mold releasing layer |
| 25: | high thermal-conduction elastic layer |
| 3: | heat pipe (heat equalizing member) |
| 31: | pipe portion |
| 32: | mold releasing layer |
| 4: | electromagnetic-induction heating section (heating section) |
| 42: | exciting coil |
| 43: | degaussing coil |
| 44: | main core |
| 45: | tail core |
| 7: | high frequency inverter |
| 8: | control unit |
| 9: | temperature sensor |

CITATION LIST

Patent Literature
JP 8-54798 A

The invention claimed is:

1. A fixing device comprising:

a fixing-side rotating member and a pressing-side rotating member which are in contact with each other to fix toner on a recording material while conveying the recording material; and a heating section for heating the fixing-side rotating member, wherein the pressing-side rotating member has at least:

a core metal;

a heat-conducting metal layer provided radially outside the core metal;

an elastic layer between the core metal and the heat conducting metal layer; and a mold releasing layer on its radially outermost side, and the heat-conducting metal layer is contiguous to the mold releasing layer.

2. The fixing device as claimed in claim 1, further comprising a heat equalizing member which is in contact with the pressing-side rotating member.

3. The fixing device as claimed in claim 2, wherein the heat equalizing member comprises a heat pipe whose operating fluid is water.

4. The fixing device as claimed in claim 3, wherein the heat equalizing member has a mold releasing layer on its radially outermost side.

5. The fixing device as claimed in claim 1, wherein the heat-conducting metal layer comprises a Ni electrocast material, SUS, Fe-based alloy, Al-based alloy, or Cu alloy, and the mold releasing layer comprises PFA powdered resin, PFA dispersion paint, PFA/PTFE mixed dispersion paint, or PFA tube.

6. The fixing device as claimed in claim 1, wherein the heat-conducting metal layer and the elastic layer are not bonded to each other.

7. An image forming apparatus including the fixing device as defined in claim 1.

8. A fixing device comprising:

a fixing-side rotating member and a pressing-side rotating member which are in contact with each other to fix toner on a recording material while conveying the recording material; and a heating section for heating the fixing-side rotating member, wherein the pressing-side rotating member includes at least:

a core metal, a low thermal-conduction elastic layer, a heat-conducting metal layer;

a high thermal-conduction elastic layer; and a mold releasing layer in this order from radially inside to outside and wherein the high thermal-conduction elastic layer is larger in thermal conductivity than the low thermal conduction elastic layer.

9. The fixing device as claimed in claim 8, wherein the high thermal-conduction elastic layer has a thermal conductivity of 0.5 W/m·° C. or more and the low thermal conduction elastic layer has a thermal conductivity of 0.3 W/m·C.° or less.

10. The fixing device as claimed in claim 8, further comprising a heat equalizing member which is in contact with the pressing-side rotating member.

11. The fixing device as claimed in claim 10, wherein the heat equalizing member comprises a heat pipe whose operating fluid is water.

12. The fixing device as claimed in claim 11, wherein the heat equalizing member has a mold releasing layer on its radially outermost side.

13. The fixing device as claimed in claim 8, wherein the heat-conducting metal layer comprises a Ni electrocast material, SUS, Fe-based alloy, Al-based alloy, or Cu alloy, and the mold releasing layer comprises PFA powdered resin, PFA dispersion paint, PFA/PTFE mixed dispersion paint, or PFA tube.

14. The fixing device as claimed in claim 8, wherein the metal layer and the low thermal-conduction elastic layer are not bonded to each other.

15. An image forming apparatus including the fixing device as defined in claim 8.

16. The fixing device as claimed in claim 8, wherein the high thermal-conduction elastic layer is formed of silicone rubber and is 150 to 300 μm thick.

* * * * *